US006147594A

United States Patent [19]

Parrella et al.

[11] Patent Number: 6,147,594

[45] Date of Patent: Nov. 14, 2000

[54] METHOD AND APPARATUS FOR CONVEYING AUDIOVISUAL INFORMATION

[75] Inventors: Michael J. Parrella, Weston; Irene Lebovics, Wilton, both of Conn.

[73] Assignee: Noise Cancellation Technologies, Inc., Linthicum, Md.

[21] Appl. No.: 09/038,571

[22] Filed: Mar. 11, 1998

[51] Int. Cl.[7] ..... G08B 27/00

[52] U.S. Cl. ..... 340/326; 384/332; 384/815.4

[58] Field of Search ..... 340/573, 407.1, 340/326, 384.1, 391.1, 573.1, 815.4, 332

[56] References Cited

U.S. PATENT DOCUMENTS

| | | | |
|---|---|---|---|
| 3,848,090 | 11/1974 | Walker | 179/1 E |
| 4,891,712 | 1/1990 | Spitzer et al. | 360/55 |
| 4,926,962 | 5/1990 | Graham et al. | 181/150 |
| 5,051,728 | 9/1991 | Wang | 340/573 |
| 5,433,035 | 7/1995 | Bauer | 40/463 |
| 5,463,369 | 10/1995 | Lamping | 340/457 |
| 5,548,272 | 8/1996 | Clark | 340/407.1 |

*Primary Examiner*—Brent A. Swarthout
*Attorney, Agent, or Firm*—R. Michelle Larson

[57] ABSTRACT

The present invention is a method and apparatus for conveying audiovisual information. The invention utilizes a speaker as a visual medium. A sheet of material is secured to the radiating face of a speaker. A visual image is then displayed on the sheet of material. Different techniques can be utilized to display the visual image on the sheet of material. For example, a video image can be projected on to the sheet of material or the sheet of material can contain a fixed image. While the visual image is being displayed on the radiating face of the speaker, audible information is being broadcast over the speaker.

18 Claims, 3 Drawing Sheets

METHOD AND APPARATUS FOR CONVEYING AUDIOVISUAL INFORMATION

CROSS REFERENCE TO RELATED APPLICATIONS

The present invention is related to the following U.S. provisional patent applications which are incorporated herein by reference:

1. Ser. No. 60/070,685 entitled "Decorative Speaker Cover" filed Jan. 7, 1998; and
2. Ser. No. 60/070,686 entitled "Thin Loudspeaker" filed Jan. 7, 1998.

The aforementioned provisional applications and the present invention are owned by Noise Cancellation Technologies, Inc.

FIELD OF THE INVENTION

The present invention relates to a new method and apparatus for conveying audiovisual information.

BACKGROUND OF THE INVENTION

Audiovisual information is constantly being conveyed in today's society. Thus, it is desirable that more effective methods and devices for conveying audiovisual information be developed. Preferably, the methods and devices will not detract from their surroundings.

U.S. Pat. No. 5,051,728 entitled Music Poster issued to Wang is an example of a relatively unobtrusive audiovisual device. The device is a poster with a sound generating system incorporated into it. The device is designed to audiovisually attract people and induce the interest of customers.

U.S. Pat. No. 5,548,272 entitled Talking Poster issued to Clark describes another unobtrusive audiovisual device. The device consists of a poster that projects recorded sound using a component that is attached to the poster. The sound producing component is covered by a material that is painted to match the color scheme of the poster art.

The present invention is able to provide a combination of visual and audio capabilities that cannot be matched by the aforementioned devices and other methods and devices.

SUMMARY OF THE INVENTION

The present invention is a method and apparatus for conveying audiovisual information. The invention utilizes a speaker as a visual medium. A sheet of material is secured to the radiating face of the speaker. A visual image is then displayed on the sheet of material. Different techniques can be utilized to display the visual image on the sheet of material. For example, a visual image can be projected on to the sheet of material or the sheet of material can contain a fixed image. While the visual image is being displayed on the radiating face of the speaker, audible information is being broadcast over the speaker.

It is an object of the present invention to provide a method and apparatus for conveying audiovisual information that is more effective than conventional methods.

DESCRIPTION OF THE INVENTION

Figure 1:
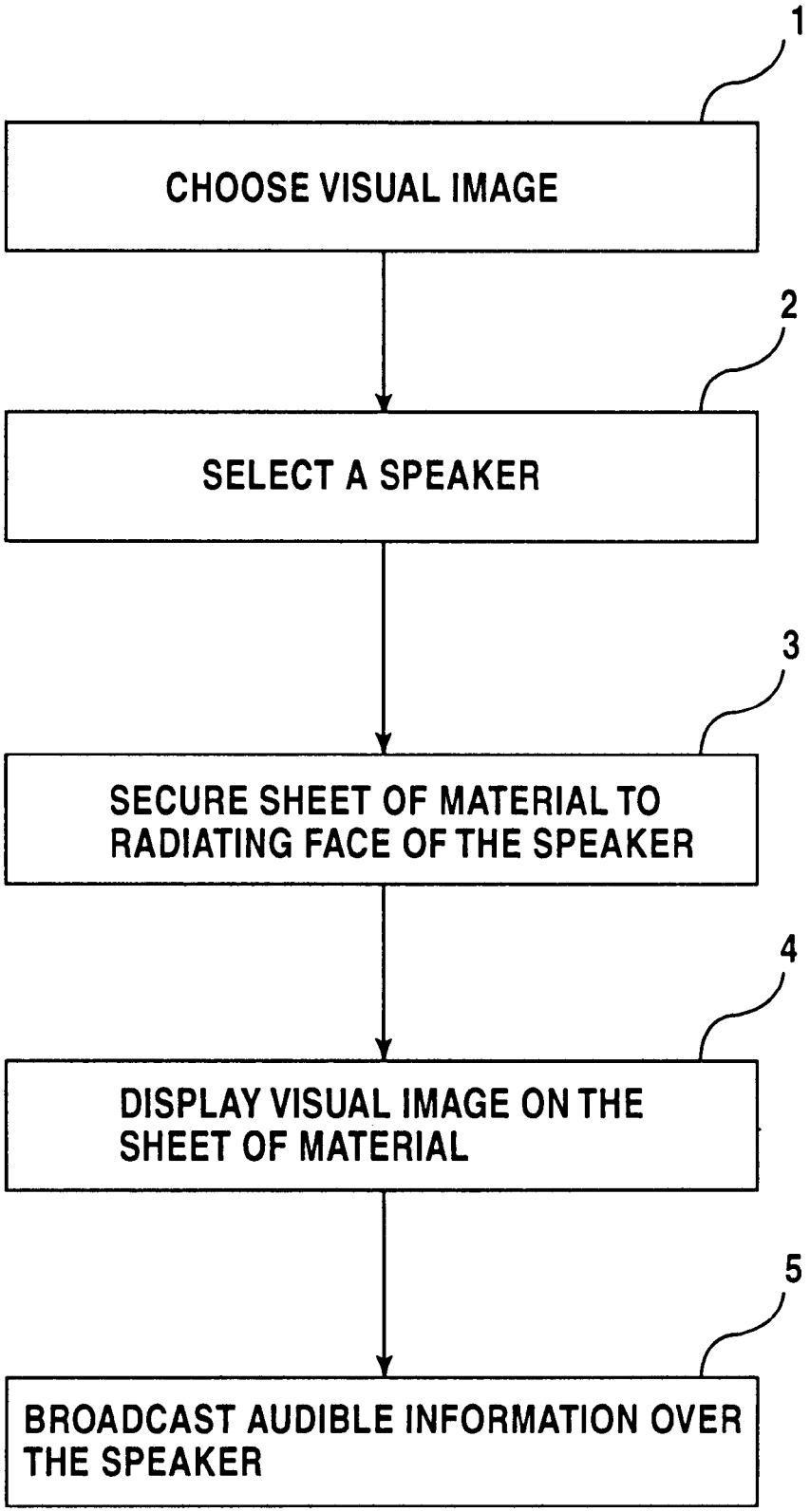
FIG. 1 is a flow diagram illustrating the method of the present invention.

FIG. 1 illustrates the method of the present invention. First, a visual image is chosen as shown in block 1. If a suitable visual image does not exist, it may be necessary to design one.

Second, a speaker is selected for use in the invention as shown in block 2. Because it is very important that the method of the invention does not detract from its environment, a speaker that is not obtrusive should be used. Gekko™ Flat Speakers manufactured by Noise Cancellation Technologies, Inc. are especially unobtrusive. Gekko™ Flat Speakers are so thin, they can easily be hung on a wall.

Third, a sheet of material is secured to the radiating face of the speaker as shown in block 3. Preferably, the sheet of material is acoustically transparent, but this is not a requirement. The sheet of material can be made of synthetic silk, ScotchPrint™ perforated vinyl, ScotchPrint™ vinyl film, or other materials. Various methods can be used to secure the sheet of material to the radiating face of the speaker.

Fourth, the visual image is displayed on the sheet of material as shown in block 4. Various techniques can be used to display the visual image. For example, the visual image can be printed or projected on to the sheet of material.

Fifth, audible information is broadcast over the speaker as shown in block 5. It is envisioned that the content of the information broadcast at different times will vary significantly. At times, the audible information might relate to the visual image displayed on the speaker. At other times, the audible information might be a mix of music and advertisements that has been recorded onto a compact disc or is being provided contemporaneously via satellite or cable.

Figure 2:
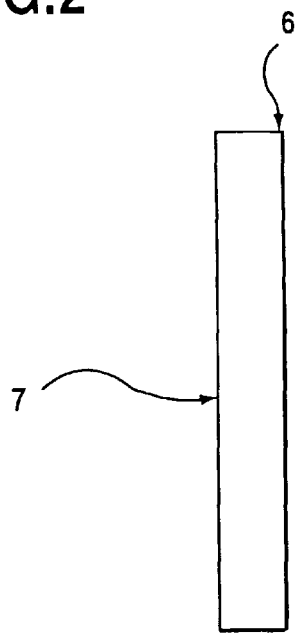
FIG. 2 shows a side view of a visual image contained on a sheet of material secured to a speaker, according to the present invention.
Figure 3:
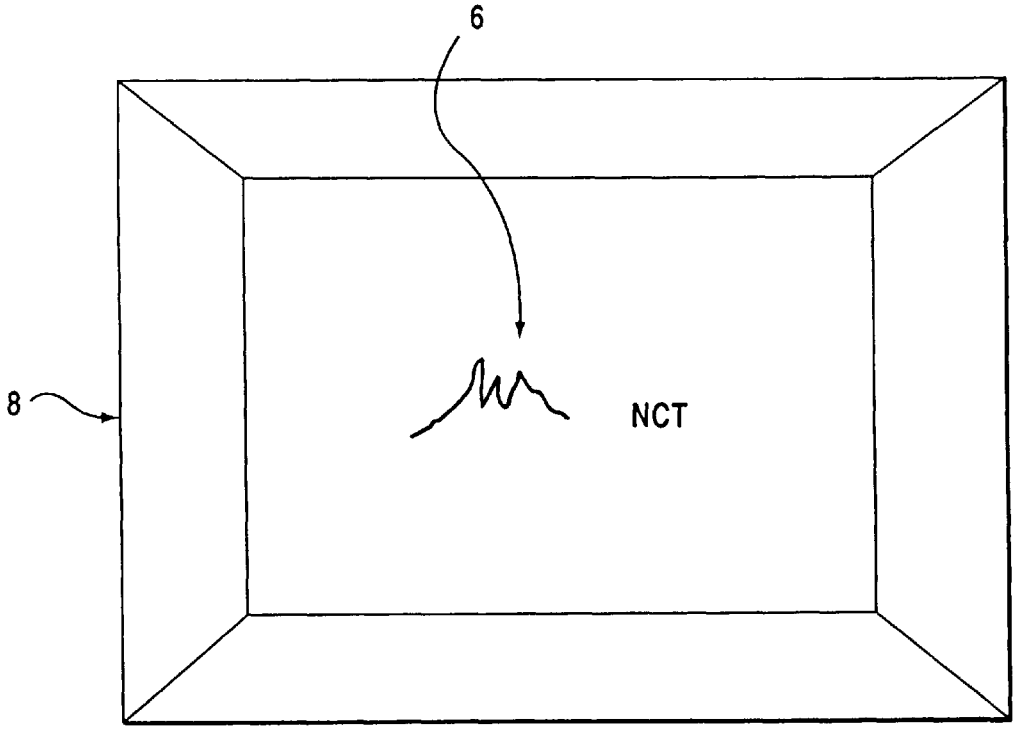
FIG. 3 is a front view of a visual image contained on a sheet of material secured to a speaker, according to the present invention.
Figure 4:
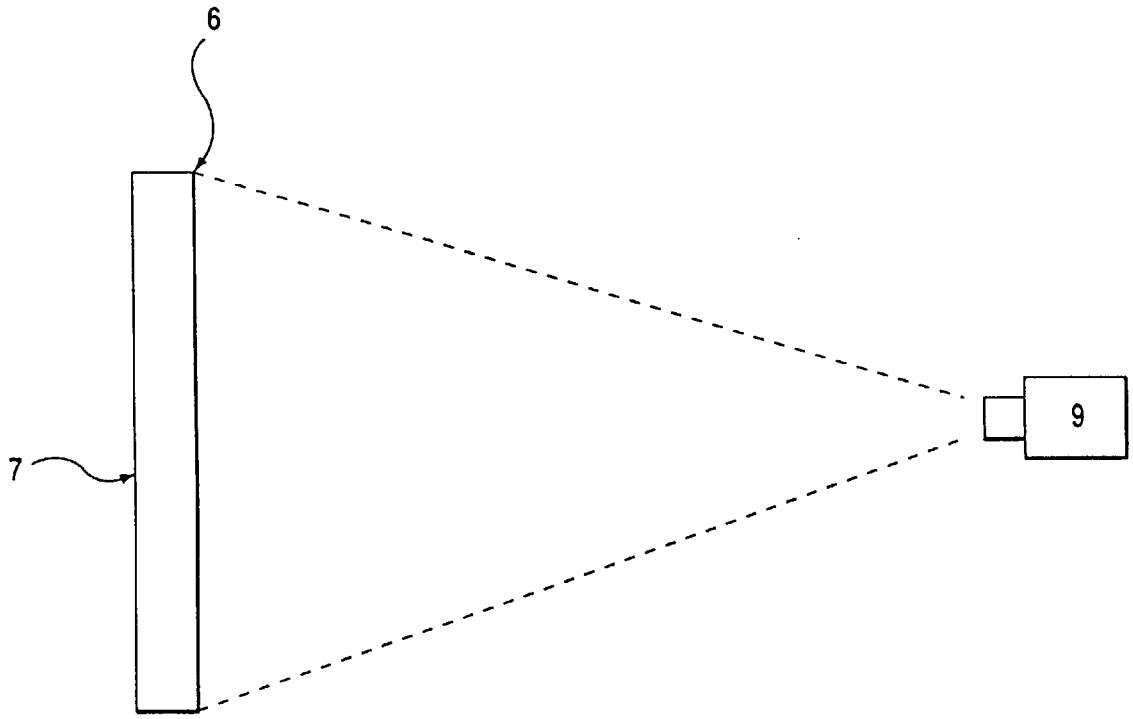
FIG. 4 shows a visual image being projected on to a blank sheet of material secured to a speaker, according to the present invention.

FIGS. 2–4 illustrate a few of the techniques that can be used to display the visual image. FIG. 2 shows a sheet of material 6 that has a visual image printed on it secured to a speaker 7. The embodiment shown in FIG. 3 includes a frame 8. In FIG. 4, the sheet of material 6 secured to the speaker 7 is blank. The visual image is projected on to the sheet of material 6 by a projector 9.

Different embodiments of the invention can be realized by including light sources, automated features, etc.

The present invention can be used for numerous purposes. For example, the invention can be used to convey audiovisual information to consumers in private and public establishments. In this particular context, the audio capabilities that result from using a speaker in the method of the invention can be used to benefit both an advertiser and an owner or operator of an establishment. At certain times, the speaker can broadcast audible information related to the visual image displayed on the radiating face of the speaker. This allows the advertiser to utilize advertising campaigns that attract customers both audibly and visually.

At other times, the speaker can be used in a traditional sense such as to broadcast compact discs or radio stations. This allows the owner or operator of an establishment to satisfy his/her own audio needs while generating valuable advertising income from the visual image displayed on the radiating face of the speaker.

It is to be understood that every aspect of the present invention has not been described explicitly. Thus, certain modifications of the invention that are not explicitly described are fully comprehended by the spirit of the invention and the scope of the claims set forth below.

We claim:

1. A method of conveying audiovisual information, comprising the steps of:

choosing a visual image capable of being dynamically changed;

selecting a speaker;

securing a sheet of material to the radiating face of the speaker; and displaying the visual image on the sheet of material by projecting or transmitting the visual image on to the sheet of material from an image source.

2. A method of conveying audiovisual information according to claim 1 wherein the step of displaying the visual image on the sheet of material comprises printing the visual image on the sheet of material.

3. A method of conveying audiovisual information, comprising the steps of:

choosing a visual image capable of being dynamically changed;

selecting a speaker;

securing a sheet of material to the radiating face of the speaker; and displaying the visual image on the sheet of material, wherein the step of displaying the visual image on the sheet of material comprises projecting or transmitting the visual image on the sheet of material from an image source.

4. A method of conveying audiovisual information according to claim 1 further comprising the step of broadcasting audible information over the speaker.

5. A method of conveying audiovisual information according to claim 4 wherein the audible information is related to the visual image displayed on the sheet of material.

6. A method of conveying audiovisual information according to claim 4 wherein the audible information is music.

7. A method of conveying audiovisual information according to claim 4 wherein the audible information is a mix of music and advertisements.

8. A method of conveying audiovisual information according to claim 4 wherein the audible information is recorded on a compact disc.

9. A method of conveying audiovisual information according to claim 4 wherein said audible information is capable of being dynamically changed.

10. A method of conveying audiovisual information, comprising the steps of:

choosing a visual image capable of being dynamically changed;

selecting a speaker;

securing a sheet of material to the radiating face of the speaker;

displaying the visual image on the sheet of material by projecting or transmitting the visual image on to the sheet of material from an image source; and broadcasting audible information over the speaker, wherein the audible information is provided via satellite.

11. A method of conveying audiovisual information, comprising the steps of:

choosing a visual image capable of being dynamically changed;

selecting a speaker;

securing a sheet of material to the radiating face of the speaker;

displaying the visual image on the sheet of material by projecting or transmitting the visual image on to the sheet of material from an image source; and broadcasting audible information over the speaker, wherein the audible information is provided via cable.

12. A method of conveying audiovisual information, comprising the steps of:

choosing a visual image capable of being dynamically changed;

selecting a speaker;

securing a sheet of material to the radiating face of the speaker;

displaying the visual image on the sheet of material by projecting or transmitting the visual image on to the sheet of material from an image source; and broadcasting audible information over the speaker.

13. A method of conveying audiovisual information according to claim 12 wherein said audible information is capable of being dynamically changed.

14. An apparatus for conveying audiovisual information, comprising:

a speaker;

a sheet of material secured to the radiating face of said speaker; and a visual image capable of being dynamically changed displayed on the sheet of material by projecting or transmitting the visual image on to the sheet of material from an image source.

15. An apparatus according to claim 14 wherein said speaker broadcasts audible information related to said visual image.

16. An apparatus according to claim 14 wherein said speaker is a flat loudspeaker.

17. An apparatus according to claim 14 wherein said sheet of material is acoustically transparent.

18. An apparatus according to claim 14 wherein said audible information is capable of being dynamically changed.

* * * * *